United States Patent [19]

Scott

[11] Patent Number: 4,883,278

[45] Date of Patent: Nov. 28, 1989

[54] MULTI-LEVEL GAME

[76] Inventor: Philip A. Scott, 2901 1st St., Marion, Iowa 52302

[21] Appl. No.: 230,518

[22] Filed: Aug. 10, 1988

[51] Int. Cl.[4] ..... A63F 3/00

[52] U.S. Cl. ..... 273/241; 273/243

[58] Field of Search ..... 273/241, 243, 255, 287, 273/248, 249

[56] References Cited

U.S. PATENT DOCUMENTS

| | | | |
|---|---|---|---|
| D. 223,540 | 5/1972 | Kayle | 273/241 |
| 2,453,907 | 11/1948 | Hare et al. | 273/243 |
| 3,399,895 | 9/1968 | Beach | 273/241 |
| 3,767,201 | 10/1973 | Harper | 273/241 |
| 3,937,471 | 2/1976 | Brennan | 273/241 |
| 4,120,503 | 10/1978 | Macrory et al. | 273/248 |
| 4,315,627 | 2/1982 | Schlegel et al. | 273/249 |
| 4,333,654 | 6/1982 | Allain | 273/241 |
| 4,348,027 | 9/1982 | Kelly | 273/241 |

*Primary Examiner*—Edward M. Coven
*Assistant Examiner*—Benjamin Layno
*Attorney, Agent, or Firm*—Leon Gilden

[57] ABSTRACT

A multi-level game is set forth wherein an upper, lower and central board game playing surface are secured together by an upper and lower post wherein each playing surface has formed thereon thirty-six squares of six rows and six columns each. Each board includes a demarcation double line on opposed sides to delineate a first row on each side of each respective game board with each space therein including a marker for indication of Home spaces for each opposing player. Eighteen tokens are provided each player with a six-sided die including six differing colorations thereon associated with six decks of playing cards with each deck of playing cards of a differing coloration equal to that of a die surface. Rolling of the die presents a coloration on a top surface thereof and indicates to alternating players a card to be picked from a corresponding deck associated with the coloration indicated by the top surface of the die. The cards provide instruction and penalty in playing of the game enabling players to utilize tokens along respective and other boards to enable traverse of the varying boards in a three dimensional manner.

6 Claims, 1 Drawing Sheet

MULTI-LEVEL GAME

BACKGROUND OF THE INVENTION

1. Field of the Invention

The field of invention relates to games and more particularly pertains to a new and improved multi-level game including the elements of chance and directing movement of respective tokens about multi-level playing surfaces.

2. Description of the Prior Art

The use of multi-level games is well known in the prior art. The games have included various features of varying types of games, such as checkers, chess and the like, to employ three dimensional characteristics into a typical two dimensional type of playing field. Examples of prior art games include a design U.S. Pat. No. 223,540 to Kayle illustrating a multi-level checkerboard-type playing surface.

U.S. Pat. No. 3,399,895 to Beach sets forth a three dimensional checker game apparatus wherein typical checker movement is utilized in effecting positioning and playing of the opposing checker pieces among the various tiers of the game boards.

U.S. Pat. No. 3,767,201 to Harper sets forth another multi-level checker and chess-type game utilizing an odd number of game boards of diminishing surface area with respect to a central game board utilizing conventional chess and checker game rules enabling horizontal and vertical movement throughout the various boards.

U.S. Pat. No. 3,937,471 to Brennan sets forth a plurality of standard chess boards in aligned overlying relationship wherein plural sets of conventional chess men are provided and enables movement utilizing conventional playing of the game of chess.

U.S. Pat. No. 4,333,654 to Allain sets forth games methods and apparatus utilizing single or multi-level playing wherein board levels are eliminated as players are eliminated during course of the game.

U.S. Pat. No. 4,348,027 to Kelley sets forth a multi-level game board utilizing chess or checker-type play wherein game boards are in varying levels or planes wherein the game is separated into a central portion at one level and a plurality of surrounding portions at other levels wherein the playing pieces are positioned on the central board initially and moved as if all of the portions of the board were in a single plane. The game differs from a standard game board in that one or more of the boards at different levels may be rotated to position a playing piece at a different relative location without moving the piece about the surface of the board to mathematically enhance the type of playing board positions available.

As such, it may be appreciated that there continues to exist a need for a multi-level game that includes aspects of chance as well as conventional movement of playing pieces and in this respect, the present invention substantially fulfills that need.

SUMMARY OF THE INVENTION

In view of the foregoing disadvantages inherent in the known types of multi-level games now present in the prior art, the present invention provides a multi-level game wherein the same combines elements of chance associated with the rolling of a die to effect movement of opposing tokens about multi-levels of game boards. As such, the general purpose of the present invention, which will be described subsequently in greater detail, is to provide a new and improved multi-level game which has all the advantages of the prior art multi-level games and none of the disadvantages.

To attain this, the present invention comprises a multi-level game board utilizing three boards of symmetrical configuration in parallel and aligned relationship to one another wherein a first row of each board comprises a Home position for each opponent on each side of each respective board wherein a six-sided die includes a separate color on each die face associated with a separate deck of cards of the same color to effect movement and penalty during respective and alternating moves of respective players.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-level game which has all the advantages of the prior art multi-level games and none of the disadvantages.

It is another object of the present invention to provide a new and improved multi-level game which may be easily and efficiently manufactured and marketed.

It is a further object of the present invention to provide a new and improved multi-level game which is of a durable and reliable construction.

An even further object of the present invention is to provide a new and improved multi-level game which is susceptible of a low cost of manufacture with regard to both materials and labor, and which accordingly is then susceptible of low prices of sale to the consuming public, thereby making such multi-level games economically available to the buying public.

Still yet another object of the present invention is to provide a new and improved multi-level game which provides in the apparatuses and methods of the prior art some of the advantages thereof, while simultaneously overcoming some of the disadvantages normally associated therewith.

Still another object of the present invention is to provide a new and improved multi-level game that combines aspects of chance in traverse of the multi-level game board levels by opposing players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5:
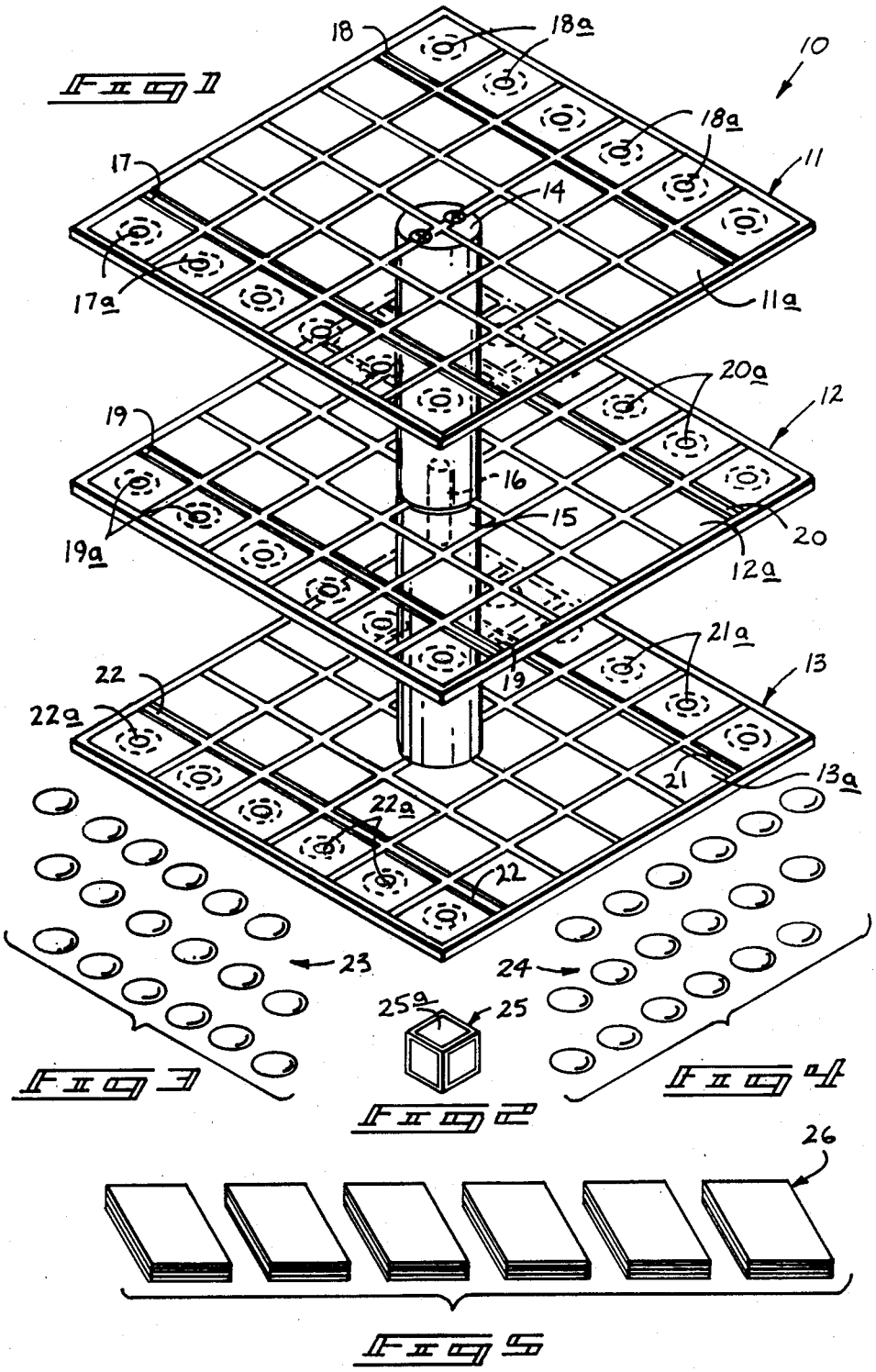
FIG. 1 is an isometric illustration of the instant invention.
FIG. 2 is a six-sided die as utilized by the instant invention.
FIG. 3 is an isometric illustration of tokens utilized by one player.
FIG. 4 is an isometric illustration of a series of tokens utilized by an opposing player.
FIG. 5 is an isometric illustration of six decks of cards utilized by the instant invention.

With reference now to the drawings, and in particular to FIGS. 1 to 5 thereof, a new and improved multi-level game embodying the principles and concepts of the present invention and generally designated by the reference numeral 10 will be described.

More specifically, it will be noted the multi-level game 10 essentially comprises a game board structure including a top game board 11, a central game board 12, and a bottom game board 13. The game boards are in overlying and aligned parallel relationship to one another equally spaced apart utilizing a plurality of medially inter-related connecting posts comprising an upper connecting post 14 and a lower connecting post 15 with a peg 16 housed within the lower connecting post 15 accepted within the upper connecting post 14 enabling selective disassembly of the game board as desired. As illustrated, the connecting post may be secured to the top and bottom game boards 11 and 13 respectively by use of conventional fastening means, such as screws and the like, or alternatively, adhesives may be utilized. The game boards 11, 12 and 13 are formed of a transparent material utilizing plastic-like materials to provide durability of construction.

Each respective game board 11, 12 and 13 are equally formed of thirty-six squares of symmetrical configuration comprising six rows of six columns each. As illustrated in FIG. 1, the first and last row of each opposing side of each respective game board is provided with double lines. Specifically, double lines 17 and 18 demarcate the first and last rows of the top game board and similarly, double lines 19 and 20 demarcate the first and last rows of the central game board 12, and finally, double lines 21 and 22 demarcate the first and last rows of the bottom game board 13. Each demarcated row, as noted, is formed with indicators illustrated as indicators 17*a*, 18*a*, 19*a*, 20*a*, 21*a*, and 22*a* associated with each respective game board to indicate the starting position of each token utilized by opposing players. Accordingly, eighteen tokens are accorded each player and are preferably of a different coloration to enable distinguishment of one player's tokens from the other. FIGS. 3 and 4 illustrate the respective first and second player tokens 23 and 24 wherein, as noted, the tokens may be of different colorations, such as red and yellow for example.

Illustrated in FIG. 2 is a single die 25 of symmetrical construction including six faces, as illustrated, with each face supporting a different coloration. More specifically, it is contemplated that the six faces utilize gray, beige, brown, blue, green, and white respectively. These colorations are utilized to coordinate the rolling of the die 25 with selection of a single card from one of the six decks of cards 26 that are also of respective gray, beige, brown, blue, green, and white coloration such that the top face 25*a* will indicate the coloration of playing card to be selected from a respective deck of playing cards 26.

The outset of the game is begun with each player positioning their respective markers of the respective space indicators 17*a*, 18*a*, 19*a*, 20*a*, 21*a*, and 22*a* with a first player utilizing indicators 17*a*, 19*a* and 22*a* and a second player utilizing indicator 18*a*, 20*a*, and 21*a* respectively. The die is thrown and as previously noted, the coloration of top face 25*a* of die 25 will indicate which card of the decks of cards 26 a player will select a top card from. During course of the play, the markers may move only at ninety degree angles from an occupied space and may not utilize diagonal moves from changing from one space to the next. A token may move from any level to an adjacent level as long as another token is not occupying that space directly above or directly below the marker to be moved. Alternatively stated, a player may not pass through or over a square occupied by an opposing marker. A capture of an opposing marker is completed when one marker terminates movement on a space occupied by an opposing marker. At that juncture that opposing marker is removed from the game boards. Another means of removing an opponents marker is to surround an opponent marker such that the opponent may not move in any direction, either horizontally or vertically per the rules of the game.

If a player's marker crosses an opponent's double line indicated by the double lines 17 through 22, that marker then becomes a royal marker and may then employ diagonal movement about the game board surfaces, both horizontally and vertically. It is understood markers may move both forwardly and rearwardly at the player's discretion, as well as vertically.

It is contemplated that each deck of the decks of cards 26 of each coloration include forty-eight cards. More specifically:

(1) gray cards include eight-move one space cards, twenty-four-move two spaces cards, sixteen-move three spaces cards, (2) beige cards include eight-move one space cards, sixteen-move two spaces cards, twenty-four-move three spaces cards, (3) brown cards include eight-move one space cards, sixteen-move two space cards, twenty-four-move three spaces cards, eight-lose turn cards, (4) blue cards include sixteen-move one space cards, sixteen-move two spaces cards, eight-move three spaces cards, four-forfeit one player cards, four-lose turn cards, (5) green cards include sixteen-move one space cards, sixteen-move two spaces cards, eight-move three spaces cards, eight-lose turn cards, (6) white cards include eight-move one space cards, twenty-four-move two spaces cards, eight-move three spaces cards, four-forfeit one player cards, four-lose turn cards.

Play is continuous for the above parameters until one player has eliminated all of the tokens of an opponent player.

The manner of usage and operation therefore of the present invention should be apparent from the above description, and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a multi-level game by two opposing players comprising, providing a game board including an upper, central and bottom game board wherein each game board is symmetrical, planar, and vertically aligned with one another, and providing a first and second set of tokens of different coloration with one set utilized by each of said opposing players, and providing a six-sided die with each face of said die of a different coloration, and providing six decks of cards wherein each deck is of a different coloration relative to one another and corresponding to a like coloration on each face of said six-sided die, and initially positioning said first and second tokens by said opposing players on respective ends of respective upper, central, and bottom game boards, and each player alternatively rolling said die and thereafter moving a respective token relative to instructions imprinted on a top card selected from one of said six decks consistent with the coloration indicated upon the top face of the die subsequent to rolling said die.

2. A method of playing a multi-level game as set forth in claim 1 wherein said game continues until one player eliminates all of the tokens of the opposing player.

3. A method of playing a multi-level game as set forth in claim 2 wherein said step of initially positioning said first and second tokens on respective ends of said game boards includes positioning said tokens on opposing ends of said game board wherein initially each of said first and second tokens are in an aligned vertical relationship relative to tokens on a vertically displaced game board.

4. A method of playing a multi-level game as set forth in claim 3 wherein the step of providing a game board further includes forming each game board with thirty-six spaces and arranging two opposing sides of each game board to include indicators for initially indicating positioning of said tokens.

5. A method of playing a multi-level game as set forth in claim 4 wherein said tokens are repositioned about said game board in orthogonal movements relative to spaces and may be further moved diagonally upon a respective token entering an opposing players initial positioning indicator space.

6. A method of playing a multi-level game as set forth in claim 5 wherein the step of providing six decks of cards includes providing said six decks of cards to each include forty-eight cards.

* * * * *